United States Patent [19]

Bianco

[11] 3,999,252

[45] Dec. 28, 1976

[54] CLAMPING DEVICE FOR HOLDING DRAWINGS

[76] Inventor: Ralph Bianco, 2582 Haverford Ave., Ardmore, Pa. 19003

[22] Filed: Dec. 9, 1974

[21] Appl. No.: 530,995

[52] U.S. Cl. ..... 24/81 AA; 248/229; 248/316 D

[51] Int. Cl.[2] ..... A44B 21/00

[58] Field of Search ..... 24/81 PC, 81 A, 81 R, 24/81 DS, 81 DC, 81 DM; 43/18 R; 403/292, 396

[56] References Cited

UNITED STATES PATENTS

| | | | |
|---|---|---|---|
| 401,662 | 4/1889 | Snow | 24/81 AG UX |
| 742,008 | 10/1903 | Cook | 24/81 DS |
| 1,821,427 | 9/1931 | Elder | 24/81 PC |
| 1,934,528 | 11/1933 | Faries | 24/81 PC |
| 2,585,603 | 2/1952 | Vaisey et al. | 24/49 CF |
| 3,245,169 | 4/1966 | Kennel | 43/18 R |
| 3,322,381 | 5/1967 | Bubb | 24/81 PC UX |
| 3,538,555 | 11/1970 | Langston | 24/137 A X |
| 3,737,178 | 6/1973 | Tjernlund | 24/81 AG X |

*Primary Examiner*—Donald A. Griffin

[57] ABSTRACT

This device consists primarily of a sleeve having C clamp means for securing it to a swivel type bench lamp. The device includes oppositely opposed and adjustable rod means carried within the sleeve, the rods having spring clamps attached thereto for holding drawings and a third and middle clip is secured to the sleeve on its exterior for providing additional support for a drawing to be held and is adaptable for use with a small drawing.

1 Claim, 4 Drawing Figures

CLAMPING DEVICE FOR HOLDING DRAWINGS

This invention relates to holding devices, and more particularly to a clamping device for holding drawings and the like.

It is therefore the principal object of this invention to provide a clamping device for holding drawings, which will neatly and respectfully render the drawings stationary in front of the user, under an illuminating means to which the device is clamped by C clamp means.

Another object of this invention is to provide a device of the type described, which will be particularly adaptable for use by those who repair electronic equipment, thus preventing the schematic or other type drawings from being scattered all over the work bench and the device, by holding the drawing, will enable the user to have more working room on the bench.

Another object of this invention is to provide a device of the type described which will be adaptable for use in many other professions, such as laboratory work, photography, blueprint reading, etc.

A further object of this invention is to provide a device of the type described, which will have clamp means for being removably secured to a typical bench lamp and sleeve means secured to the clamp of the device will slidably and adjustably receive rod means having clamp means secured fixedly thereto, the clamp means consisting of the spring type paper holders and a central spring clip will be secured to the outer periphery sleeve holding the rods so as to hold a small drawing or provide additionally support for a large drawing in conjunction with the clips of the rod members.

A still further object of this invention is to provide a device of the type described, which may be adaptable for use with a base having adjustable and telescoping sleeve means.

Other objects of the invention are to provide a clamping device for holding drawings, which is simple in design, inexpensive to manufacture, rugged in construction, easy to use and efficient in operation.

These and other objects will be readily evident upon a study of the following specification and the accompanying drawing, wherein.

Figure 1:
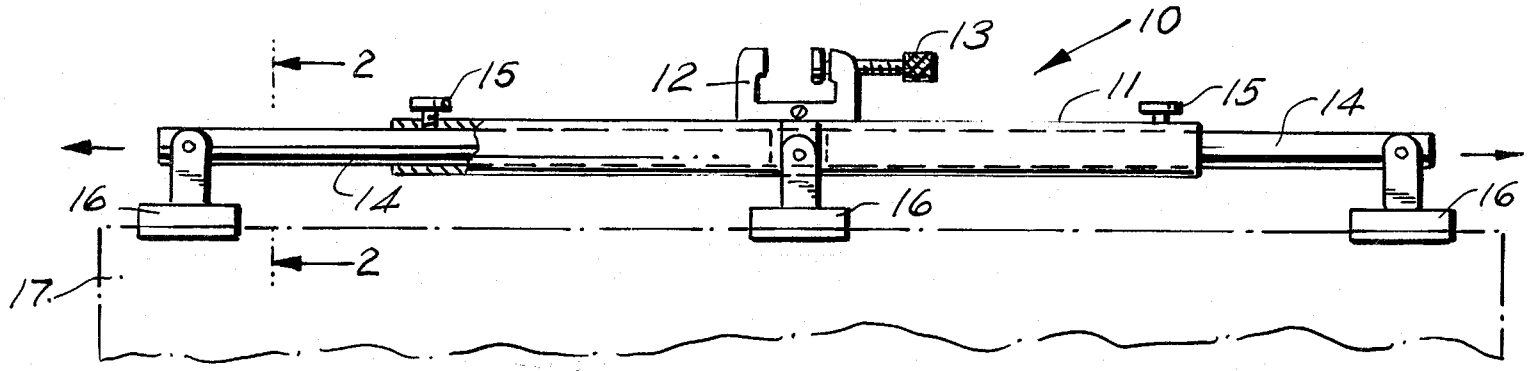
FIG. 1 is a front view of the present invention shown in elevation and partly broken away with a schematic drawing being shown in phantom lines.

According to this invention, a clamping device 10 for holding drawings, includes an elongated sleeve 11 of light weight metal or plastic material. Secured fixedly to sleeve 11 is a C clamp 12 having an adjustment screw 13 which enables releasable securement of device 10, to a swivel base lamp or the like.

A pair of solid rods 14 are, one each, adjustably received within sleeve 11 and are positioned at any length telescopingly from sleeve 11, and are held stationary by means of set screws 15.

A plurality of spring clips 16, one being secured fixedly to the center of the outer periphery of sleeve 11 and the other clips 16 are secured fixedly, one each, to the end of the rods 14. The spring clips 15 in conjunction with clips 16 of sleeve 11 provide for holding large drawings under the illuminated area of the lamp and the spring clip 16 secured to sleeve 11 provides for the holding of a small drawing 17 when desired.

Figure 4:
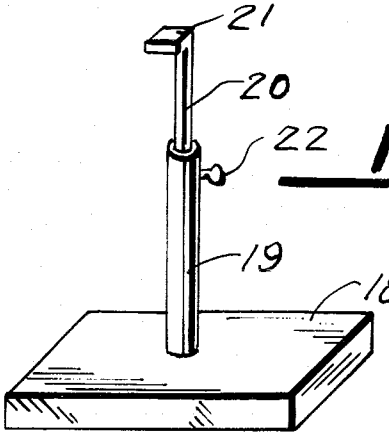
FIG. 4 is a perspective view showing a base for the optional mounting of FIG. 1.
Figure 2:
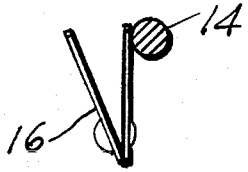
FIG. 2 is a transverse cross sectional view taken along the line 2—2 of FIG. 1.

As will be seen in FIG. 4 of the drawing, an optional means for attachment to sleeve 11 consists of a heavy rectangular base 18 having fixedly secured thereto, a sleeve 19 which telescopingly receives rod 20 having a head portion 21 for mounting sleeve 11. Rod 20 is elevatable within sleeve 19 to any desired height and is secured in any desired position, by means of the set screw fastener 22 within sleeve 19.

Figure 3:
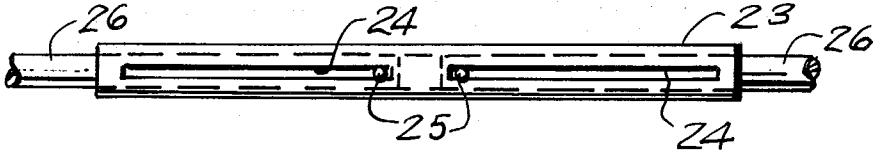
FIG. 3 is a fragmentary plan view showing a modified sleeve and rod arrangement.

Referring now to FIG. 3 of the drawing, a modified sleeve 23 is provided with a pair of spaced apart and elongated openings 24 within which freely ride, one each, an extending pin 25 fixedly secured, one each, to the extending rods 26, the arrangement providing for continuous adjustment of length without the use of set screw fasteners.

It shall be noted that all of the components heretofore described may be made of plastic materials for cheapness and lightness.

What I claim is:

1. A clamping device for holding drawings, comprising in combination, an elongated sleeve, a pair of rods, one each of said rods extending from each end of said sleeve, said rods together having a length that is greater than the length of said sleeve whereby ends of said rods protrude outwardly of said sleeve when said rods are fully retracted inwards within said sleeve, a spring clip being secured to a center of said sleeve, and a separate spring clip secured to each outward end of said rods providing means for holding said drawings, all three said spring clips being axially aligned for grasping a straight edge of said drawings.

* * * * *